US005728226A

United States Patent [19]

Hoyt

[11] Patent Number: 5,728,226

[45] Date of Patent: Mar. 17, 1998

[54] PROCESS FOR CLEANING AN ASSEMBLED SPIN PACK OF A MELT SPINNING ASSEMBLY

[75] Inventor: Matthew Buckingham Hoyt, Arden, N.C.

[73] Assignee: BASF Corporation, Mount Olive, N.J.

[21] Appl. No.: 685,986

[22] Filed: Jul. 22, 1996

[51] Int. Cl.[6] ..... B08B 3/04

[52] U.S. Cl. ..... 134/1; 134/22.1; 134/10; 134/22.11; 134/42; 264/39; 264/442

[58] Field of Search ..... 134/1, 22.1, 10, 134/42, 22.11; 264/39, 442

[56] References Cited

U.S. PATENT DOCUMENTS

| | | | |
|---|---|---|---|
| 2,974,070 | 3/1961 | Domgeren | 134/1 |
| 3,436,789 | 4/1969 | Hays | 264/39 |
| 3,488,412 | 1/1970 | Bielfeldt et al. | 264/39 |
| 3,671,653 | 6/1972 | Berry, Jr. | 264/39 |
| 4,124,666 | 11/1978 | Wilholm et al. | 264/39 |
| 4,714,526 | 12/1987 | Pennisi et al. | 203/49 |
| 4,976,900 | 12/1990 | Tsutsumi | 264/39 |
| 5,126,058 | 6/1992 | Beckman | 210/774 |
| 5,233,021 | 8/1993 | Sikorski | 528/491 |

*Primary Examiner*—Jill Warden
*Assistant Examiner*—Sharidan Carrillo
*Attorney, Agent, or Firm*—Nixon & Vanderhye P.C.

[57] ABSTRACT

A supercritical fluid (SCF) or near SCF is used in a cleaning process for cleaning a spin pack of a melt spinning apparatus. The SCF enables cleaning of the spin pack without requiring spin pack disassembly. In an exemplary embodiment, the SCF is recirculated to a recirculating chamber where polymer residue can be precipitated from the SCF, and the SCF can be re-purified for subsequent cycling through the same or a next assembled spin pack.

12 Claims, 1 Drawing Sheet

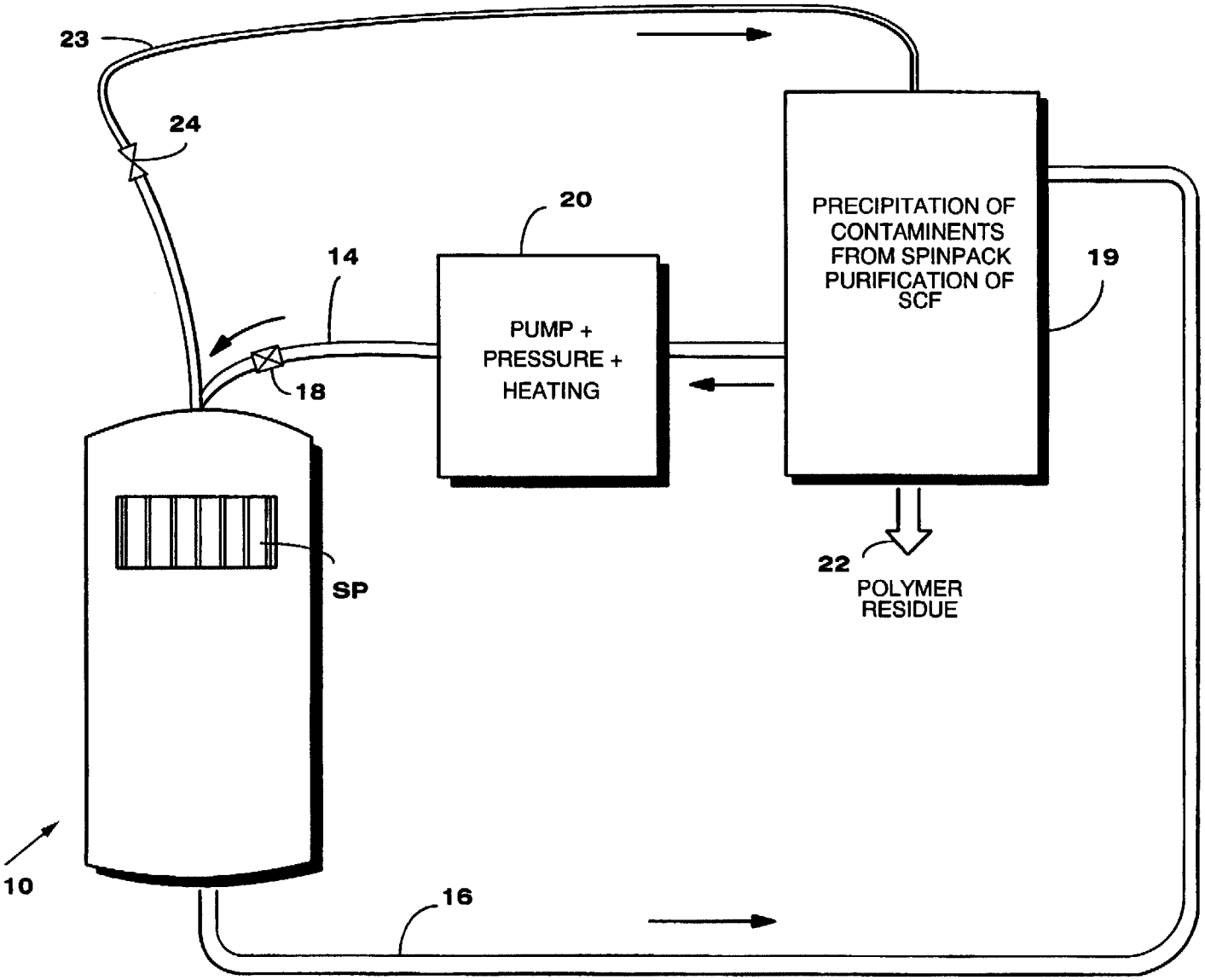
PRECIPITATION OF CONTAMINENTS FROM SPINPACK PURIFICATION OF SCF
19
POLYMER RESIDUE
22
PUMP + PRESSURE + HEATING
20
14
18
SP
16
24
23
10

PROCESS FOR CLEANING AN ASSEMBLED SPIN PACK OF A MELT SPINNING ASSEMBLY

FIELD OF THE INVENTION

The present invention relates generally to melt spinning assemblies. In preferred forms, the present invention is embodied in a process for cleaning a spin pack of a melt spinning assembly without necessarily requiring disassembly of the spin pack.

BACKGROUND OF THE INVENTION

Currently, a costly and time consuming part of the manufacture of melt spun synthetic fibers is the disassembly, cleaning (e.g., so as to remove polymer residue) and reassembly of the spin pack in the melt spinning assembly. A spin pack generally includes some filtration structure, such as sand, screens, sintered metal filters, or shattered metal, disposed in a spinnerette plate. The spinnerette plate includes a plurality of small-sized orifices, wherein a melt spinnable polymer is extruded through the orifices to form a stream of filaments, which ultimately form a yarn composed of multiple filaments. In addition, spin packs typically require internal seals that must be replaced each time the spin pack is disassembled and cleaned.

Conventional spin pack cleaning processes in current use typically subject a disassembled spin pack to two cycles of extreme elevated temperatures in an oven (each cycle being colloquially referred to as a "burn off"). In the first cycle, the spin pack is heated in a vacuum oven to remove polymer residue without burning the polymer. Subjecting the spin pack to extreme elevated temperatures, however, sometimes causes the metal of the spin pack to be heated unevenly. Moreover, the polymer residue when heated to extreme elevated temperatures can emit noxious gases, requiring sensitive environmental constraints. In the second cycle, the spin pack is disassembled and the individual parts are placed in a steam-blanketed, forced-air oven to remove additional polymer residue. After two such "burn offs," the spin pack pieces are washed in an ultrasonic bath and a caustic bath. In the caustic bath, the spin pack parts are cleaned in a non-aqueous solvent such as ethylene glycol or triethylene glycol, each of which poses solvent disposal problems.

SUMMARY OF THE INVENTION

According to the present invention, a process for cleaning a spin pack of a melt spinning assembly is provided wherein cleaning of the spin pack can be accomplished without spin pack disassembly. In this regard, the process according to the invention includes cleaning an assembled spin pack using what is known as supercritical fluids (SCF).

A supercricital fluid (SCF) results when a material is elevated to a temperature above its critical temperature and a pressure above its critical pressure. It is known that heavy non-volatile substances dissolve in supercritical fluids (dense gases, compressed gases, supercritical gases, high-pressure gases), typically 2–7 orders of magnitude in excess of the amount based on the ideal gas law. This is due to the high density of the fluid, which can approach that of a liquid. Thus, supercritical fluids offer both high solubility extraction based on the enhancement of vapor pressure and nearly complete solvent-extract separation which is accomplished by reducing solvent density to the gaseous state.

Polymers in synthetic filament production normally require very harsh solvent systems for dissolution. It has been discovered that SCF's are capable of dissolving many polymers including those used in the production of synthetic filaments. Suitable SCF materials for dissolving polymers include, for example, acetic acid, carbon dioxide, water, methane and mixtures thereof, the use of which eliminates problems associated with solvent disposal.

In the cleaning process, the assembled spin pack is cleaned in a sealed vessel containing an SCF bath. Alternatively or additionally, the vessel is provided with an inlet and an outlet, wherein the SCF is recirculated to a recirculating chamber where the polymer residue can be precipitated from the SCF, and the SCF can be purified for repeated spin pack cleaning. Subsequently, the spin pack may be subjected to an ultrasonic bath to clean any residual polymer.

These and further aspects and advantages of the present invention will become more dear after careful consideration is given to the following detailed description of preferred embodiments.

BRIEF DESCRIPTION OF THE DRAWINGS

Reference will hereinafter be made to the accompanying drawing, wherein the FIGURE illustrates an assembly for carrying out a process of the invention.

DETAILED DESCRIPTION OF PREFERRED EMBODIMENTS

It is known that an SCF is capable of dissolving polymers used in the production of synthetic filaments. Thus, when the spin pack SP is exposed to the SCF, the spin pack SP is cleaned without having to disassemble the spin pack SP. Hence, cleaning times are shortened, and costs associated with cleaning are reduced.

An SCF is a material, for example carbon dioxide or water, that is raised to a temperature above its critical temperature and to a pressure above its critical pressure. As is well established, the SCF at these parameters exhibits gas-like characteristics with liquid-like densities. Table I shows the critical temperatures and pressures for various materials particularly suitable as SCFs for dissolving polymers.

| MATERIAL | Critical Temperature K. | Critical Pressure (MPa) |
|---|---|---|
| Carbon Dioxide | 304.1 | 7.375 |
| Water | 647.1 | 22.06 |
| Methanol | 512.6 | 8.092 |
| Acetic Acid | 592.7 | 5.786 |

As noted above, when these materials are elevated to temperatures and pressures above the critical level, the materials become SCFs.

The FIGURE is a schematic illustration of an exemplary cleaning chamber that is used to carry out the cleaning process according to the present invention. An extraction vessel 10, which is sealed from the atmosphere, includes an inside area 12 that is sized to receive a spin pack SP of a melt spinning apparatus. In one embodiment, the vessel 10 receives a supercritical fluid (SCF) bath such that the assembled spin pack SP is exposed to the SCF for a predetermined period of time. An appropriate extraction vessel is one manufactured by Engineered Pressure Systems of Andover, Mass. The details of the vessel 10 will therefore not be further described.

In another embodiment of the invention, with continued reference to the FIGURE, the vessel 10 is provided with an inlet 14 and an outlet 16 in a fluid recirculating system. The inlet 14 is in fluid communication with a valve assembly 18, which serves to guide the SCF along a polymer path through the spin pack SP. Liquid or gaseous carbon dioxide or water or other materials that has not been converted into an SCF (i.e., fluid that has not been subjected to parameters such as increased pressure and temperature to convert the fluid into a supercritical fluid) is contained in a recirculating chamber 19. Alternative SCFs that are particularly effective against nylon are acetic acid and a mixture of methanol and water. The "pre-supercritical" fluid flows along the inlet 14 to a known supercritical pump vessel 20, which subjects the fluid to supercritical parameters such as increased pressure and temperature, to raise the fluid to an SCF. The pump vessel 20 forces the SCF along the inlet 14 and through the valve assembly 18.

After flowing through the assembled spin pack SP, the fluid and dissolved polymer exit the vessel 10 via the outlet 16. The supercritical fluid and polymer residue are then recirculated back to the chamber 19, whereupon the fluid is reduced to a "pre-supercritical" fluid, and the polymer residue is precipitated from the fluid in a known manner and discharged via an outlet 22. The "pre-supercritical" fluid can then be recirculated through the pump vessel 20 and forced along the polymer path in a recirculating path. Because the SCF poses no environmental hazard, the SCF exiting through the outlet 16 can be easily disposed. In accordance with this embodiment, the spin pack SP may be simultaneously subjected to an SCF bath during pumping of the SCF through the spin pack SP.

The vessel 10 is preferably further provided with a return line 23, including a valve 24 that is used for dissolved contaminants until the spin pack SP is clean enough to support flow through the pack. That is, the polymer path may be obstructed with polymer residue preventing proper flow of the SCF through the spin pack. Thus, the return line 23 is utilized initially until the polymer path is clear enough to support the SCF flow.

Subsequent to cleaning in the chamber 10, the spin pack SP may be subjected to a conventional ultrasonic bath to ensure that all remaining polymer residue has been removed. The ultrasonic bath typically uses water, and thus, the entire cleaning process is environmentally sensitive.

As used herein and in the accompanying claims, the term "supercritical fluid" is meant to encompass materials at a temperature at least about 0.9 times the material's critical temperature (K) and at a pressure greater than the material's critical pressure. Ideally, the temperature range for the SCF utilized according to the present invention is about 0.9–1.2 times the material's critical temperature.

The process according to the invention provides an efficient cleaning method for cleaning a spin pack SP of a melt spinning assembly without requiring disassembly of the spin pack SP. The use of an SCF in the cleaning process provides significant advantages over prior cleaning processes, including shorter cleaning times and reduced cleaning costs.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A process for removing solidified polymer residue from an assembled synthetic fiber spin pack comprising bringing the assembled spin pack into contact with a supercritical fluid (SCF) for a time sufficient to remove solidified polymer residue therefrom.

2. A process as claimed in claim 1, wherein the assembled spin pack is submerged in the SCF.

3. A process as claimed in claim 1, further comprising the step of subjecting the spin pack to an ultrasonic bath after contacting the spin pack with the supercritical fluid.

4. A process as claimed in claim 1, wherein the SCF is selected from the group consisting of carbon dioxide, water, methanol, acetic acid and mixtures thereof.

5. A process as claimed in claim 1, wherein the SCF is forced through the assembled spin pack along a polymer path.

6. A process as claimed in claim 5, further comprising the steps of recirculating the polymer residue-containing SCF fluid and precipitating the polymer residue from the SCF.

7. A process as claimed in claim 5, further comprising the step of submerging the spin pack in the SCF for a predetermined period of time simultaneously with the step of forcing the SCF through the assembled spin pack.

8. A process as claimed in claim 1, wherein the SCF is at a temperature at least about 0.9 times its critical temperature and at a pressure above its critical pressure.

9. A process as claimed in claim 8, further comprising the step of raising the SCF to a pressure above its critical pressure and to a temperature at about 0.9–1.2 times its critical temperature.

10. A process as claimed in claim 8, wherein the SCF is selected from the group consisting of carbon dioxide, water, methanol, acetic acid and mixtures thereof.

11. A process as claimed in claim 8, further comprising the step of submerging the spin pack in the SCF for a predetermined period of time and simultaneously forcing the SCF through the assembled spin pack along a polymer path.

12. A process as claimed in claim 8, further comprising the steps of recirculating the polymer residue-containing SCF fluid and precipitating the polymer residue from the SCF.

* * * * *